US010914468B2

(12) United States Patent
Risseeuw et al.

(10) Patent No.: US 10,914,468 B2
(45) Date of Patent: Feb. 9, 2021

(54) BURNER APPARATUS AND METHOD OF COMBUSTION

(71) Applicants: AIR PRODUCTS AND CHEMICALS, INC., Allentown, PA (US); TECHNIP BENELUX B.V., Zoetermeer (NL)

(72) Inventors: Izaak Risseeuw, Zoetermeer (NL); Jeffrey Kloosterman, Allentown, PA (US); Xianming Jimmy Li, Orefield, PA (US); Robert Gregory Wolf, Hackettstown, NJ (US); Reed Jacob Hendershot, Orefield, PA (US); Franciscus Arnoldus Maria Jeunink, Delfgauw (NL)

(73) Assignees: TECHNIP BENELUX B.V., Zoetermeer (NL); AIR PRODUCTS AND CHEMICALS, INC., Allentown, PA (US)

( * ) Notice: Subject to any disclaimer, the term of this patent is extended or adjusted under 35 U.S.C. 154(b) by 19 days.

(21) Appl. No.: 16/083,195

(22) PCT Filed: Mar. 6, 2017

(86) PCT No.: PCT/EP2017/055205
§ 371 (c)(1),
(2) Date: Sep. 7, 2018

(87) PCT Pub. No.: WO2017/153348
PCT Pub. Date: Sep. 14, 2017

(65) Prior Publication Data

US 2019/0093881 A1 Mar. 28, 2019

(30) Foreign Application Priority Data

Mar. 11, 2016 (EP) ..... 16159997

(51) Int. Cl.
*F23C 6/04* (2006.01)
*F23D 14/70* (2006.01)
*F23D 14/24* (2006.01)

(52) U.S. Cl.
CPC ..... *F23C 6/047* (2013.01); *F23D 14/24* (2013.01); *F23D 14/70* (2013.01);
(Continued)

(58) Field of Classification Search
CPC ..... F23C 6/047; F23D 14/24; F23D 14/70
(Continued)

(56) References Cited

U.S. PATENT DOCUMENTS 2,052,869 A 9/1936 Coanda
3,419,339 A 12/1968 Schreter et al.
(Continued)

FOREIGN PATENT DOCUMENTS

CN 1038153 A 12/1989
EP 1031790 A1 8/2000
(Continued)

*Primary Examiner* — Steven B McAllister
*Assistant Examiner* — Aaron H Heyamoto

(57) ABSTRACT

A burner apparatus (10) includes a fluid-based flame stabilizer for discharging a stabilized flame therefrom, a burner tile (44), and fuel lances associated with the burner tile. Each of the fuel lances has a discharge nozzle (40). A Coanda feature (34) having a Coanda surface directs a portion of the stabilized flame from the passage defined by the burner tile at the discharge end of a primary flow passage (32) toward at least one first fuel lance of the plurality of fuel lances to cross light the at least one first fuel lance. In another embodiment, a method of combustion includes supplying a first gaseous fuel to fuel lances of a burner apparatus and igniting and sustaining combustion of a gaseous fuel by cross lighting at the discharge nozzles of the fuel lances by
(Continued)

flow from the fluid-based flame stabilizer along a Coanda surface of a Coanda feature toward the discharge nozzles.

15 Claims, 5 Drawing Sheets

(52) U.S. Cl.
CPC ..... *F23C 2201/20* (2013.01); *F23C 2201/30* (2013.01); *F23C 2900/06043* (2013.01)

(58) Field of Classification Search
USPC ..... 431/8
See application file for complete search history.

(56) References Cited

U.S. PATENT DOCUMENTS 3,695,820 A 10/1972 Hawkes et al.
4,347,052 A * 8/1982 Reed ..... F23C 6/047 431/188
6,752,620 B2 * 6/2004 Heier ..... F23C 5/32 431/173
6,773,256 B2 8/2004 Joshi et al.
7,878,798 B2 * 2/2011 Poe ..... F23D 14/08 431/351
8,337,197 B2 12/2012 Poe et al.
8,529,247 B2 9/2013 Poe et al.
8,568,134 B2 10/2013 Poe et al.
2010/0021853 A1 1/2010 Bussman
2010/0227284 A1 * 9/2010 Daneri ..... C21C 5/5217 431/159
2012/0270161 A1 10/2012 Poe et al.

FOREIGN PATENT DOCUMENTS

EP 1191281 A1 3/2002
EP 2216291 A1 8/2010

* cited by examiner

BURNER APPARATUS AND METHOD OF COMBUSTION

It is generally recognized that fuel-staged burners produce lower $NO_x$ emissions than premixed or air-staged or non-staged burners. The reduction in $NO_x$ increases with fuel staging. Distributing the fuel spatially reduces combustion intensity and allows for more furnace gas entrainment, both of which can contribute to lower $NO_x$ production. The number of points where fuel is injected and the distance from the centerline also have an effect. However, as more fuel is staged and staged farther from the centerline of the burner, the flame can become more unstable, requiring a pilot or some form of flame stabilization device. This is especially true under start-up conditions, where the environment in which the burner resides is cool relative to normal operating conditions. Internal or external pilots may be required to stabilize the flame until the environment in which the flame is propagating is of a sufficiently high temperature to keep all of the fuel tips lit. In addition, when the fuel is ignited, the flame must propagate and light the remaining staged fuel tips. This phenomenon of lighting one fuel injection location from an already ignited fuel injection location is known as cross lighting. The stabilized flame and the staged fuel must cross light to maintain safe and stable operation of the burner.

Cross lighting is made more difficult as the distance from fuel tips of flame to flame becomes greater and as the combustion intensity of each individual tip decreases. One solution that has attempted to address the problem of cross lighting is the use of a continuous pilot. However, a continuous pilot is designed to have greater combustion intensity to insure the staged fuel remains lit. Fuel for the pilot, on the order of 5-20% of the total heat release, may be required to maintain the flame stability. The pilot burner flames generate significant $NO_x$, which may require abatement equipment downstream to meet environmental regulations. One way to lessen this effect is to only run a pilot during start-up until the furnace reaches conditions which promote more stable combustion, e.g. above the fuel auto-ignition temperature. This type of pilot may be termed a start-up lance or start-up mode. A start-up lance or mode may likely have a greater capacity than a continuous pilot to speed the initial heating process, thereby generating more $NO_x$, but only over a finite length of time. Functionally, this requires extra components to accomplish the desired cross lighting for flame stability, thereby increasing the cost of the burner. Operationally, this also requires human intervention, automated controls and associated equipment, or both to complete the task. This increases the risk for an unsafe situation during start-up, as errors are a function of the number of steps in a procedure.

Eliminating or reducing the pilot, whether continuous or of finite duration, may significantly reduce $NO_x$ production. In addition, retaining the stability that the pilot imparts is paramount. Thus, state-of-the-art burners balance these two elements. Example of burners, which utilizes a large scale vortex (LSV) flame stabilization device to stabilize a fuel stage burner design, are described in U.S. Pat. Nos. 6,773,256 and 6,752,620. The LSV flame stabilizer provides an extremely stable flame under oxygen-rich, fuel-lean operating conditions and the LSV burner can produce significantly lower $NO_x$ than conventional non-staged or air-staged technologies. The LSV flame stabilizer also produces lower $NO_x$ relative to other means of flame stabilization, e.g. pilot burner. During start-up, it may be preferred to use a start-up lance to heat up the furnace. If a start-up lance is desired, the fuel source should be diverted from the outer staged fuel tips to the start-up lance. The start-up lance generates significantly more $NO_x$ than either the LSV flame stabilizer or the staged fuel tips. It is desirable to limit or eliminate the start-up lance to minimize $NO_x$ emissions. The 3-way valve must be turned after start-up to move from the initial start-up mode into low-$NO_x$ mode. The valve and associated piping adds cost to the burner as well as additional steps that operating staff have to take when starting up the burners. This may be tolerable for a single burner, but several to over a hundred burners may need to be transitioned in a short period of time in process applications.

As described in U.S. Pat. No. 2,052,869, a fluid phenomenon, known as the Coanda effect, includes an unbalancing effect in the flow of a surrounding fluid induced by a sheet or stream of fluid, which discharged thereinto. The effect permits a deflection of the fluid stream that penetrates with a high velocity into another fluid.

CN1038153A, U.S. Pat. Nos. 3,419,339, and 3,695,820 describe the application of the Coanda effect to premix fuel and air, before having the mixture encounter a flame stabilizer downstream of the Coanda surface. The flame is stabilized on a physical surface downstream of the mixing point.

U.S. Pat. No. 7,878,798 and its divisionals, U.S. Pat. Nos. 8,337,197, 8,529,247, and 8,568,134, disclose various ways to entrain furnace gas into the burner block to lower $NO_x$.

U.S. Patent Application Publication No. 2010/021853 utilizes the Coanda effect to propagate the flame to cross light staged fuel tips for $NO_x$ reduction. The burner tile protrudes into the furnace and the Coanda surface is located within the burner block. The burner utilizes a pilot flame, which extends forward past a bluff body and is curved using the Coanda effect to cross light the stage fuel tips which reside inside the furnace. The flame propagates along a channel within the block. The premix pilot is conventional, with a flame stabilizer downstream of the pilot. The stabilizer helps anchor the flame within the extended tile. Both of these features are lacking from an LSV burner, as the LSV is not contained by a refractory block or stabilized by a physical surface. Instead it is self supported in an LSV by velocity differences, which confines the combustion into a donut shaped flame at the center of the burner, far away from the refractory tile. In fact, a large passage which allows air to flow through the burner exists between the LSV and the staged fuel lances. Air in U.S. 2010/021853 is directed through the center of the tile and is diverted into the passages, where the flames are propagated, as well as travelling directly out the throat of the burner.

All above-mentioned references are hereby incorporated by reference herein in their entirety.

The present invention relates to an LSV burner system with at least one Coanda surface to direct flow to cross light at least one fuel stage tip.

In certain embodiments, the burner apparatus includes a fluid-based flame stabilizer for discharging a stabilized flame therefrom, a burner tile, and a plurality of fuel lances associated with the burner tile. The burner tile defines a primary flow passage therein. The primary flow passage defined by the burner tile has an inlet end, a discharge end, and a wall connecting the inlet end to the discharge end and surrounding the primary flow passage. The fluid-based flame stabilizer is operatively disposed to direct the stabilized flame into the primary flow passage of the burner tile. Each of the plurality of fuel lances has a discharge nozzle. The discharge nozzles of the plurality of fuel lances are positioned proximate the discharge end of the passage of the burner tile and spaced to distribute a first gaseous fuel proximate the discharge end of the passage of the burner tile. A first Coanda feature has a Coanda surface directing a portion of the stabilized flame from the primary flow passage defined by the burner tile at the discharge end of the primary flow passage toward at least one first fuel lance of the plurality of fuel lances to cross light the at least one first fuel lance.

In another embodiment, the method of combustion includes supplying a first gaseous fuel to a plurality of fuel lances of a burner apparatus and igniting and sustaining combustion of a first gaseous fuel by cross lighting at the discharge nozzles of the fuel lances by flow from the fluid-based flame stabilizer along a Coanda surface of a Coanda feature toward the discharge nozzles.

Other features and advantages of the present invention will be apparent from the following more detailed description of the preferred embodiment, taken in conjunction with the accompanying drawings which illustrate, by way of example, the principles of the invention.

The articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

The phrase "at least a portion" means "a portion or all".

As used herein, "plurality" means at least two.

As used herein, "Coanda surface" means a surface convexly-curved in a direction of fluid flow in a manner such that the fluid flowing along the surface deviates from a linear flow direction and toward the direction of the curving surface. In the present application, the Coanda surface preferably directs a portion of fluid flow from a passage toward at least one fuel stage tip discharge nozzle.

As used herein, "Coanda feature" means any structure having a Coanda surface.

As used herein, "fluid-based flame stabilizer" is any device wherein one or more fluids are introduced into a duct through at least two nozzles at different fluid velocities and a streamwise vortex (eddy) is formed within the duct due to difference in the fluid velocities. In some embodiments, the fluid-based flame stabilizer is a large scale vortex (LSV) flame stabilization device. An exemplary LSV flame stabilizer is described in U.S. Pat. No. 6,773,256. In other embodiments, other flame-stabilizing methods and devices may be used, including, but not limited to, premixing of fuel and oxidant, a bluff body inducing mixing, and a hot surface initiating and propagating a flame.

As used herein, a duct is any pipe, tube, conduit, or channel that is capable of conveying a gas.

For the purposes of simplicity and clarity, detailed descriptions of well-known devices, circuits, and methods are omitted so as not to obscure the description of the present invention with unnecessary detail.

The present invention provides an LSV burner system and method that improve stability for extremely fuel-lean combustion, eliminate the need for a start-up mode, including a start-up lance or a 3-way valve, improve reliability by elimination of a 3-way valve, eliminate the need for a physical flame-holding device or a bluff body to stabilize the flame, allow use of inexpensive construction materials (for example, carbon steel, aluminized carbon steel, stainless steel, or more expensive high temperature steel alloys), simplify manufacture, allow spacing of the fuel tips farther from the central passage, allow more or deeper staging of the fuel, reduce the Btu/hr content of the central pilot needed to cross light the burner tips, reduce the possibility for damage and degraded burner performance, improve stability with increasing air flow, reduce peak flame temperatures, reduce $NO_x$ emissions, or combinations thereof.

The present invention relates to an LSV burner with at least one Coanda feature having a Coanda surface. The LSV burner may operate either as a stand-alone burner or as one component in a staged combustion burner or burner system.

Preferred embodiments of the present invention will now be described with reference to the drawings in which.

Figure 1:
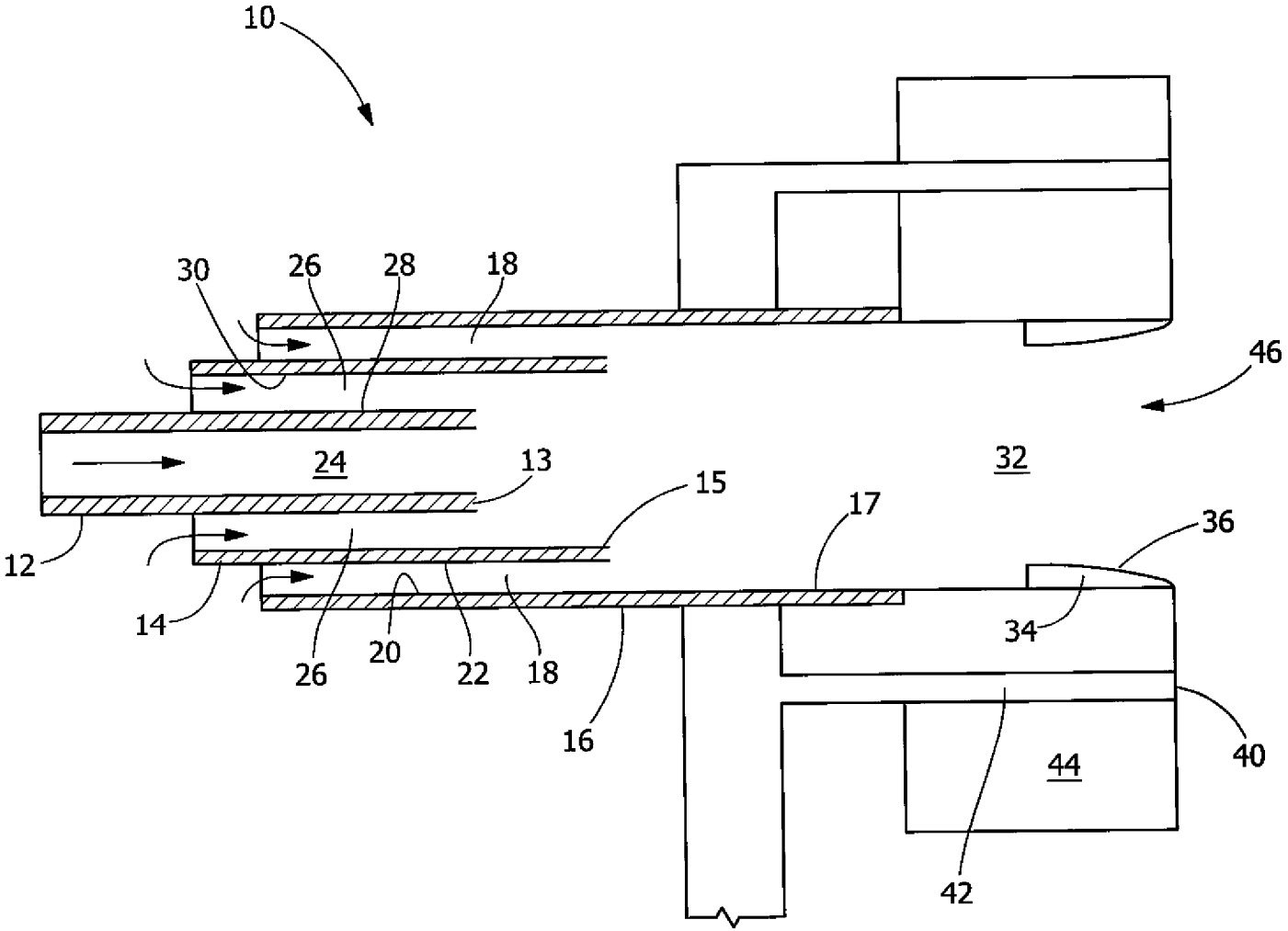
FIG. 1 is a schematic cross sectional view of a symmetric LSV burner system in an embodiment of the present disclosure.

Referring now to the drawings, there is shown in FIG. 1 a device for stabilization of a flame in a combustion (or burner) apparatus 10 in accordance with the first preferred embodiment of the present invention. Here, the device (or apparatus) 10 includes a secondary oxidant pipe 12 recessed inside a fuel pipe 14, which is further recessed inside an outer, primary oxidant pipe 16. A primary oxidant pipe forward end 17 extends past a fuel pipe forward end 15 which, in turn, extends past a secondary oxidant pipe forward end 13. A primary oxidant (such as air) is introduced axially, at relatively high velocity and flow rate through a hollow, primary oxidant flow conduit 18 that is formed between the internal surface 20 of the primary oxidant pipe 16 and the external surface 22 of the fuel pipe 14. A secondary oxidant (such as air, which may be the same oxidant as the primary oxidant or a different oxidant) is directed through the secondary oxidant pipe 12 (that is, through an internal secondary oxidant conduit 24) at a lower velocity and flow rate. Fuel is directed through a hollow, fuel flow conduit 26 formed between the secondary oxidant pipe external surface 28 and the fuel pipe internal surface 30.

A stabilizing structure includes a primary flow passage 32 surrounded by a Coanda feature 34 having an internal Coanda surface 36. The primary flow passage 32 is a singular passage in which a stabilized flame is capable of being supported. In systems having multiple flow passages, the primary flow passage 32 is the passage having the greater cross-section or supports the largest volume of flame. In one embodiment, the combustion apparatus 10 includes only a singular, unitary passage to support the stabilized flame, the singular, unitary passage being the primary flow passage 32. In another embodiment, the combustion apparatus 10 is devoid of and does not include separate or secondary passages for redirecting the stabilized flame. The Coanda feature 34 directs a portion of the fluid flow from the primary flow passage 32 toward at least one fuel stage tip discharge nozzle 40 of a fuel lance 42 in a burner tile 44 arranged annularly around the discharge end 46 of the combustion apparatus 10. The Coanda feature 34 may extend as an annulus around the entire discharge end 46 of the combustion apparatus 10 or alternatively may extending only around a portion of the discharge end 46 of the combustion apparatus 10, where the combustion apparatus may include one or more additional Coanda features 34, as shown in FIG. 2.

Figure 2:
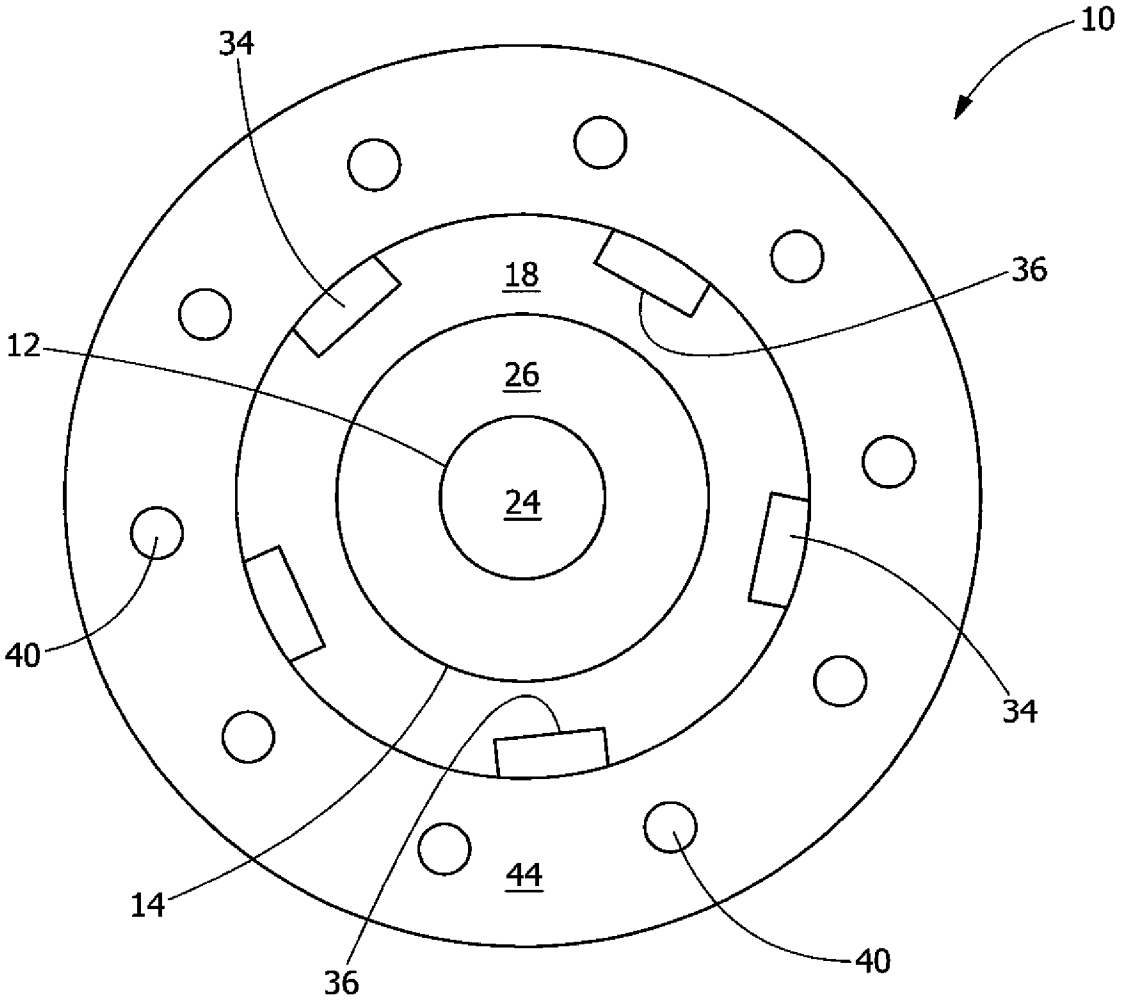
FIG. 2 is a schematic end view of a symmetric LSV burner system in an embodiment of the present disclosure.

The end view of FIG. 2 more clearly shows the Coanda features 34 and the fuel stage tip discharge nozzles 40 in the burner tile 44. The combustion apparatus 10 includes ten discharge nozzles 40 and five Coanda features 34 spaced between pairs of discharge nozzles 40 to direct flow to the discharge nozzles 40 by way of the Coanda surfaces 36 to cross light the discharge nozzles 40. The secondary oxidant pipe 12, the fuel pipe 14, the primary oxidant flow conduit 18, the secondary oxidant conduit 24, and the fuel flow conduit 26 are also visible in the end view of the combustion apparatus 10. Although a specific number and configuration of Coanda features 34 and discharge nozzles 40 is shown in FIG. 2, any number and any configuration of Coanda features 34 and discharge nozzles 40 may be used in the present invention. In some embodiments, the Coanda features 34 may be aligned with the discharge nozzles 40 rather than being offset between them as in FIG. 2. In one embodiment, the combustion apparatus 10 is devoid of and does not include a bluff body at or adjacent the discharge end 46 of the primary flow passage 32. Further, in another embodiment, the combustion apparatus 10 is devoid of and does not include bluff body at or adjacent the Coanda feature 34.

Figure 3:
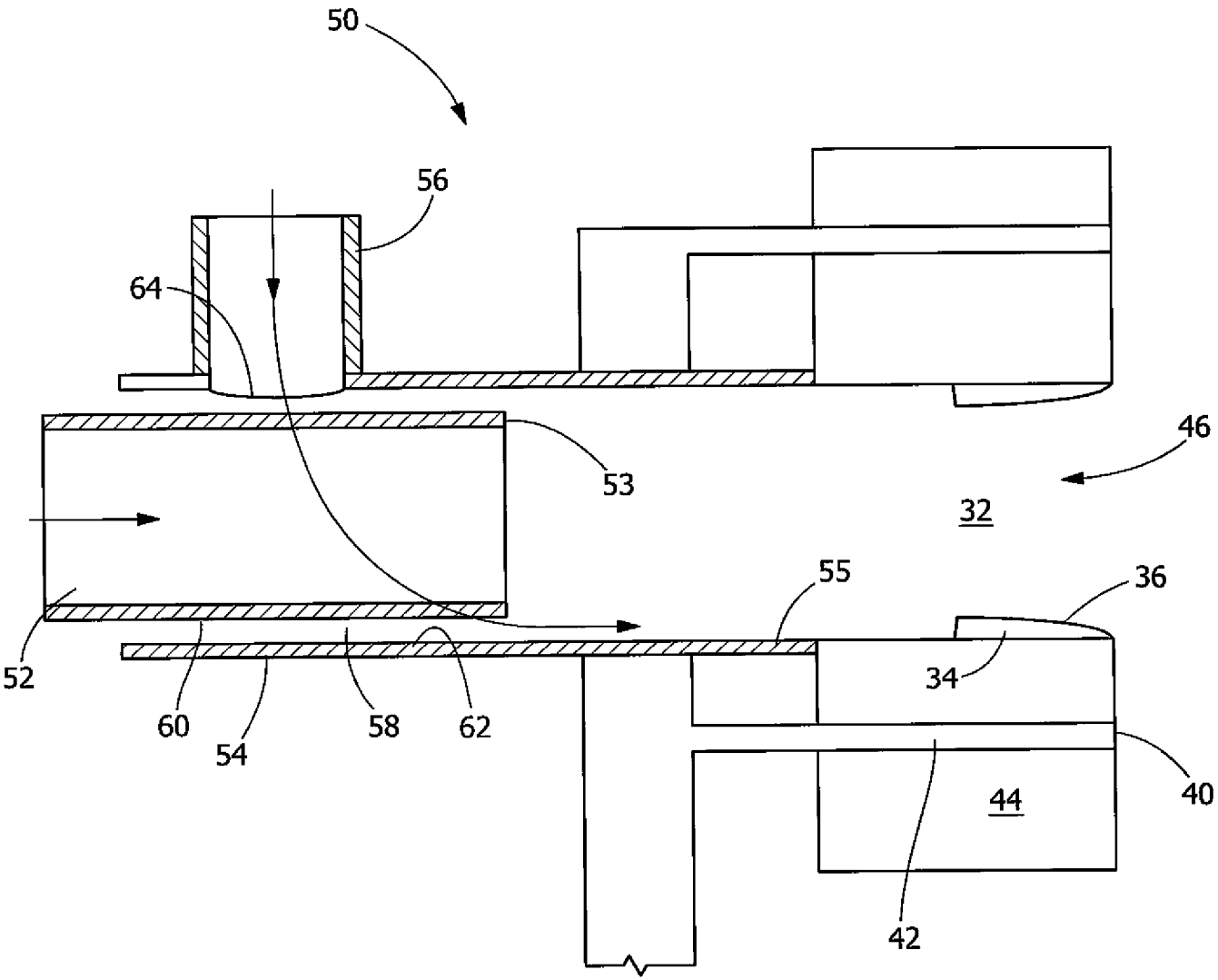
FIG. 3 is a schematic cross sectional view of an asymmetric LSV burner system in an embodiment of the present disclosure.

Next, there is shown in FIG. 3 a device for stabilization of a flame in a combustion device 50 in accordance with the second preferred embodiment of the present invention. The device for stabilization 50 includes a fuel pipe 52 through which fuel from a fuel source flows, recessed inside a larger pipe, i.e., oxidant pipe 54, into which an oxidant (such as air) from an oxidant source is introduced through an oxidant feed pipe 56 at an angle that is preferably perpendicular to fuel flow through the fuel pipe 52. The oxidant pipe 54 has an oxidant pipe forward end 55 and the fuel pipe 52 has a fuel pipe forward end 53. The oxidant pipe forward end 55 extends past the fuel pipe forward end 53. The oxidant flow naturally segregates in an oxidant flow conduit 58, i.e., a hollow, cylindrical annulus formed between the fuel pipe external surface 60 and the oxidant pipe internal surface 62. The flow segregates into a high velocity flow that is opposite the oxidant feed pipe inlet 64 to the oxidant flow conduit 58 and into a low velocity flow adjacent to the oxidant feed pipe inlet 64. Thus, the requirement for a high velocity primary oxidant stream and a lower velocity, secondary oxidant stream is satisfied.

As with FIG. 1, the stabilizing structure includes a primary flow passage 32 surrounded by a Coanda feature 34 having an internal Coanda surface 36. The Coanda feature 34 directs a portion of the fluid flow from the primary flow passage 32 toward at least one fuel stage tip discharge nozzle 40 of a fuel lance 42 in a burner tile 44 arranged annularly around the discharge end 46 of the combustion apparatus 50. The Coanda feature 34 may extend as an annulus around the entire discharge end 46 of the combustion apparatus 10 or alternatively may extending only around a portion of the discharge end 46 of the combustion apparatus 10, where the combustion apparatus may include one or more additional Coanda features 34.

The symmetric design of the device of the first embodiment 10 provides for a lower pressure drop than the asymmetric second embodiment 50 and eliminates direct flame impingement on a burner and uneven furnace heating inherent to the asymmetric design. The relatively low temperatures experienced by either embodiment of the present invention allow construction using common, inexpensive materials.

Figure 4:
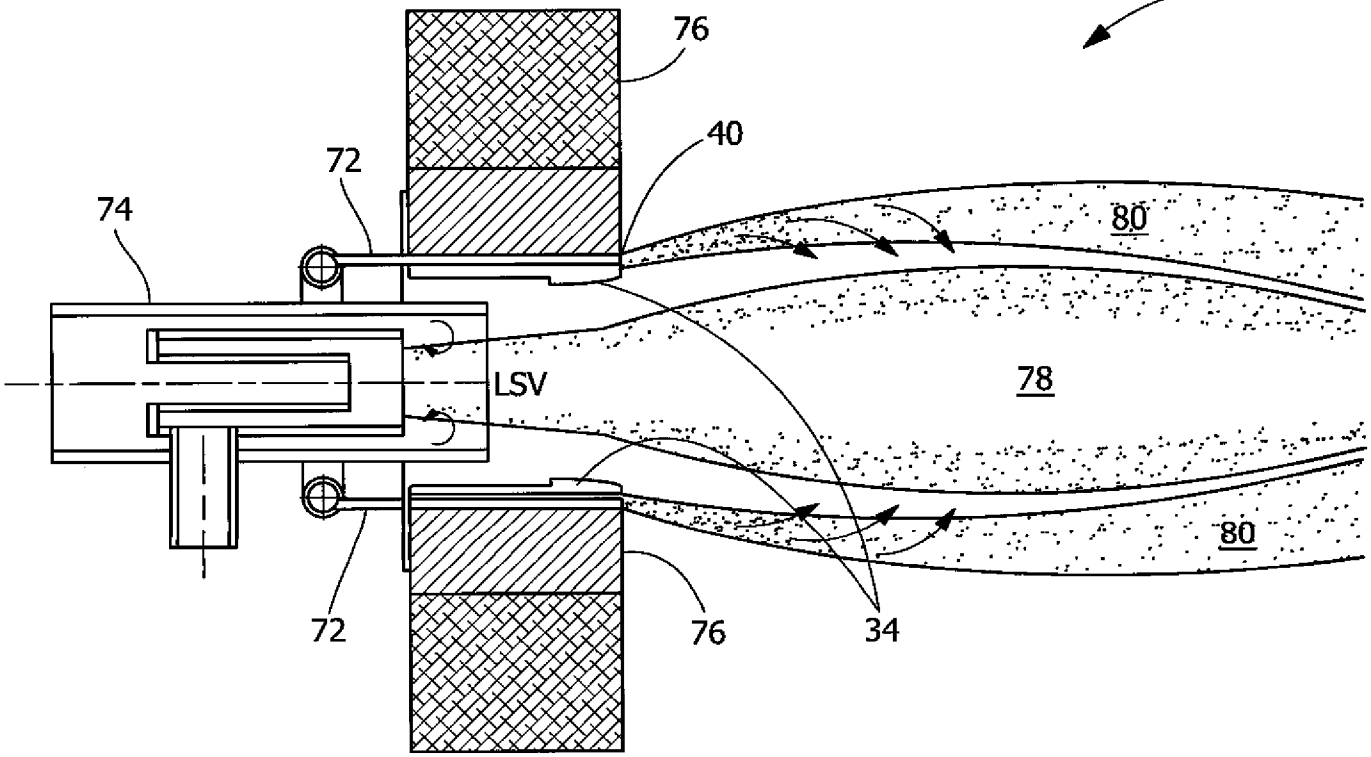
FIG. 4 is a schematic cross sectional view of an LSV burner with a flame in an embodiment of the present disclosure.

As shown in FIG. 4, the fuel staging of a burner system 70 is performed using a circular staging configuration with multiple diverging lances 72 installed around the LSV device 74 or the burner tile 76 exterior. The Coanda features 34 direct fluid toward the discharge nozzles 40 to cross light the fuel stage. The primary flame 78 and the fuel stage flames 80 are also shown in FIG. 4.

Figure 5:
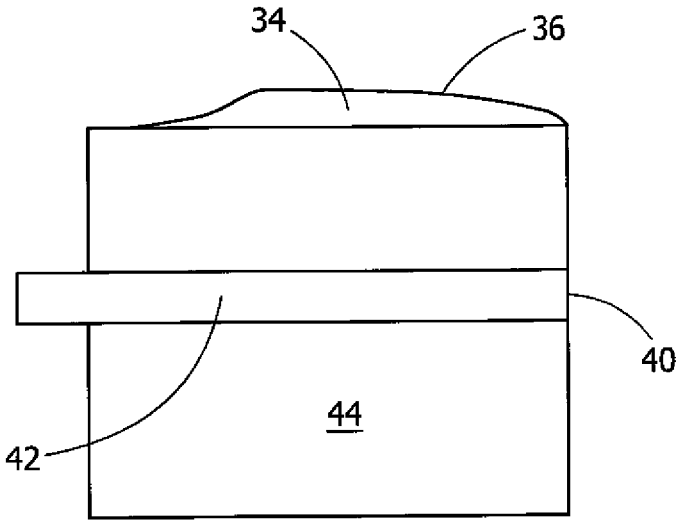
FIG. 5 is a schematic cross sectional view of a Coanda feature in an embodiment of the present disclosure.

Although FIG. 1 through FIG. 4 show one profile for an internal Coanda surface 36, many different surface profiles may be used to achieve cross lighting flow in the present invention. FIG. 5 shows an alternate profile of an internal Coanda surface 36 of a Coanda feature 34 with a more gradual rise at the upstream end. The Coanda feature 34 extends from the burner tile 44 to direct flow to the discharge nozzle 40 of the fuel lance 42 to cross light the fuel stage.

The Coanda surface 36 may be shaped and located in any manner such that it directs at least a portion of the stabilized flame from the primary flow passage 32 defined by the burner tile at the discharge end of the primary flow passage 32 toward at least one of the fuel lances to cross light that fuel lance. In some embodiments, the Coanda feature 34 is an integral part of the burner tile. In other embodiments, the Coanda feature 34 is attached to the burner tile. In yet other embodiments, the Coanda feature 34 is provided as part of an insert extending into the primary flow passage 32 such that the Coanda feature 34 is located adjacent the burner tile or contacting the burner tile but may or may not be physically attached to the burner tile.

The LSV flame is preferably maintained extremely fuel-lean (e.g., phi=0.05, or 20 times the amount of air required for stoichiometric combustion, where phi is the stoichiometric ratio of fuel-to-air) and is anchored on the LSV fuel pipe. This flame gets more stable as the primary airflow through the relatively narrow outer oxidant annulus is increased. The LSV flame has a very low peak flame temperature (preferably less than 1093° C. (~2000° F.) and produces very low $NO_x$ emissions. This is due to excellent mixing, avoidance of fuel-rich zones for prompt $NO_x$ formation (as observed in traditional flame holders) and completion of overall combustion under extremely fuel-lean conditions.

In this method of fuel staging, the resulting combustion (above auto ignition temperature) is controlled by chemical kinetics and by fuel jet mixing with the furnace gases and oxidant. The carbon contained in the fuel molecule is drawn to complete oxidation with the diluted oxidant stream instead of the pyrolitic soot-forming reactions of a traditional flame front. It is assumed here that combustion takes place in two stages. In the first stage, fuel is converted to CO and $H_2$ in diluted, fuel rich conditions. Here, the dilution suppresses the peak flame temperatures and formation of soot species, which would otherwise produce a luminous flame. In the second stage, CO and $H_2$ react with diluted oxidant downstream to complete combustion and form $CO_2$ and $H_2O$. This space-based dilution and staged combustion leads to a space filling process where a much larger space surrounding flame is utilized to complete the overall combustion process.

Preferably, the oxidant is air and natural gas is the fuel. However, any appropriate oxidant in combination with any appropriate fuel, as known in the art, may be used.

In the LSV burner, the actual stabilized flame from the LSV extends outside the burner into the furnace slightly. Air flows over the internal Coanda surface 36, generating a lower pressure with flow from the flame causing the flame to propagate to cross light the fuel staging tips. Hence, the Coanda feature 34 propagates the flame. Start-up lances may be removed as a result of the presence of the Coanda feature 34. The Coanda feature 34 preferably does not actively disrupt the airflow within the primary flow passage 32.

For the specific case of an oxidant as air and natural gas fuel, various optimal ranges for flow (e.g., $V_f$=60.96-182.88 cm/sec (2-6 ft/sec); $V_{pa}$=914.40-2,743.20 cm/sec (30-90 ft./sec).; $V_{sa}$=457.2-1371.6 cm/sec (15-45 ft./sec.—$V_f$ is fuel velocity, $V_{pa}$ is primary air velocity and the $V_{sa}$ is secondary air velocity) and non-dimensional geometric (e.g., length/diameter) parameters have been determined for a cylindrical design of the burner devices. It is noted that while use of cylindrical pipes operate properly in accordance with the present invention, numerous other shapes of pipes also operate properly so long as the relative speeds of the fuel and oxidants are supplied in accordance with the present invention.

One or more curved surfaces of the Coanda feature 34 provide an exterior flow for the inner LSV flame to propagate from near the burner centerline across an air passage and to the fuel staging tips located some distance away from the centerline. The air passage does not contain fuel and therefore the flame must bridge fuel between the central LSV and the staged fuel tips in order to be effective. The addition of the Coanda feature 34 eliminates the need for a start-up lance and lowers the fuel requirement of the LSV to achieve the same stable flame, even in a cold furnace environment.

The surface of the Coanda feature 34 preferably only has a slight curvature, which induces a lower pressure at the surface, causing the flame to remain on the surface and propagate outward. If the curvature is too great, the fuel and flame detach from the surface and no longer perform its function. The surface creates a waterfall-like flame that appears to flow outward towards the staged fuel lances. In some embodiments, the Coanda surface 36 has the convex cross section of at least a portion of a circle or the convex shape of at least a portion of a cylinder. In other embodiments, the Coanda surface 36 has a convex elliptical cross sectional shape. In some embodiments, the Coanda feature 34 has a width of about 10.16 cm. (4 inches).

One Coanda feature 34 may be used to promote the cross lighting of one to all of the fuel staging lances depending on the burner configuration. Multiple Coanda features 34 may alternatively be used to ensure the cross lighting takes place quickly, reducing the risk for uncombusted fuel entering the furnace. The spacing and size of the Coanda features 34 may include widths measured perpendicular to the fluid flow that provide the cross lighting of the fuel staging lances. For example, the width of the Coanda feature 34 may be from about 5.08 cm. (2 inches) to about 10.16 cm. (4 inches). Likewise, the spacing or placement of the Coanda features 34 along the surface of the primary flow passage 32 may vary. For example, the placement may be aligned with the fuel staging lances in the primary flow passage 32 or may be placed intermediate to the fuel staging lances in the primary flow passage 32 at distances sufficient to provide the cross lighting of the fuel staging lances.

The Coanda surfaces 36 preferably have a curvature sufficient to maintain fluid flow and re-direct the flame flow to the burner tip but not curved beyond the limit at which the flame's flow departs from the curved surface. A preferred curvature maintains a laminar flow of the flame while avoiding conditions that would be considered to produce an aerodynamic 'stall'. An optimal curvature may depend on the flow speed of the flame, the dimensions of the burner, and the desired amount of flame deflection. In one embodiment, particularly good cross-lighting and flame propagation results are obtained for a Coanda feature having Coanda surfaces having dimensions:

length equal to the distance burner tile 76 exterior-to-LSV device 74 and width equal to the distance burner tile-to-LSV device (74).

Most applications of a Coanda surface in relation to a flame in the art are seen in flares to promote premixing of uncombusted fuel and air prior to the ignition point. Such use usually requires a flame holder or other flame stabilization downstream of the surface. Also, when used to propagate a flame, the Coanda surface has been restricted to within the burner block structure itself and not exposed to the furnace environment as an external element of the burner. The Coanda feature 34, described herein on an LSV burner, reduces the $NO_x$ produced by the burner by lowering the fuel requirement of the LSV. The device also eliminates the capital and operating concerns of the start-up lance.

Laboratory experiments were conducted as a proof of concept and computational fluid dynamics (CFD) analysis was used to visualize the effect of the surface on the flame and flow patterns. The results of that work are presented in the next section.

EXAMPLES

The testing of two Coanda surfaces in an LSV burner with only 10% fuel to the LSV flame stabilizer over a range of fuels confirmed the surface increased cross lighting as well as light off in a cold furnace. Testing was performed with natural gas as the fuel and with propane as the fuel. Visual inspection clearly indicated the effect of the Coanda surface curving the flame toward the staged fuel tips. The cross lighting of the tips was confirmed with flamelets stabilized at less than 5.08 cm (2 inches) from the staged fuel tips. The device was found to be very effective in a cold furnace environment and provided low-$NO_x$ operation.

In this initial testing, the Coanda feature was provided as part of a vane device made of carbon steel inserted in the burner air passage to form the surface used to stabilize the flame. A set of test points within the burner were monitored with an indication that they all were stable. The tested LSV burner was stable in low $NO_x$ mode up to a firing rate of 2 megawatts (MW) for propane and natural gas in a cold firebox. Burner light off and turndown was demonstrated at a firing rate of 200 kilowatts (kW) for propane and natural gas in a cold firebox at a draft combustion air flow rate of 124.5 Pa. (0.5 inch water-column (wc)). At a higher draft combustion air flow rate of 249.1 Pa (1 inch wc), the minimum firing rate was about 700 kW for propane and for natural gas.

Computer Fluid Dynamics modeling confirmed the effect of the angle of the Coanda surface on its ability to direct flow up to a maximum angle of 90 degrees. The results clearly showed an increase in the bending of streamlines as the angle was reduced below 90 degrees.

While the invention has been described with reference to certain aspects or embodiments, it will be understood by those skilled in the art that various changes may be made and equivalents may be substituted for elements thereof without departing from the scope of the invention. In addition, many modifications may be made to adapt the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A burner apparatus comprising:

a fluid-based flame stabilizer for discharging a stabilized flame therefrom;

a burner tile defining a primary flow passage therein, the primary flow passage having an inlet end, a discharge end, and a wall connecting the inlet end to the discharge end and surrounding the primary flow passage, wherein the fluid-based flame stabilizer is operatively disposed to direct the stabilized flame into the primary flow passage of the burner tile; and a plurality of fuel lances associated with the burner tile, each of the plurality of fuel lances having a discharge nozzle, the discharge nozzles of the plurality of fuel lances being positioned proximate the discharge end of the primary flow passage of the burner tile and spaced to distribute a first gaseous fuel proximate the discharge end of the primary flow passage of the burner tile;

wherein a first Coanda feature having a Coanda surface directs a portion of the stabilized flame from the primary flow passage defined by the burner tile at the discharge end of the primary flow passage toward at least one first fuel lance of the plurality of fuel lances to cross light the at least one first fuel lance;

wherein the first Coanda feature having a Coanda surface protrudes into the primary flow passage.

2. A burner apparatus according to claim 1, wherein the discharge nozzles are located within 10 cm (3.94 inches) of the discharge end of the primary flow passage of the burner tile.

3. A burner apparatus according to claim 1, wherein the fluid-based flame stabilizer comprises:

a first duct having an inlet end, a discharge end, and a wall extending from the inlet end of the first duct to the discharge end of the first duct, the wall thereby defining a first passage for passing a first oxygen-containing gas therethrough;

a second duct having an inlet end, a discharge end, and a wall extending from the inlet end of the second duct to the discharge end of the second duct, the first duct disposed partially within the second duct thereby defining a second passage between the external surface of the first duct and the internal surface of the second duct for passing a second gaseous fuel therethrough, wherein the discharge end of the first duct is recessed from the discharge end of the second duct; and a third duct having an inlet end, a discharge end, and a wall extending from the inlet end of the third duct to the discharge end of the third duct, the second duct disposed partially within the third duct thereby defining a third passage between the external surface of the second duct and the internal surface of the third duct for passing a second oxygen-containing gas therethrough, wherein the discharge end of the second duct is recessed from the discharge end of the third duct.

4. A burner apparatus according to claim 3, wherein the first gaseous fuel and the second gaseous fuel have the same composition.

5. A burner apparatus according to claim 3, wherein the first oxygen-containing gas and the second oxygen-containing gas have the same composition.

6. A burner apparatus according to claim 5 further comprising an oxygen-containing gas source operatively disposed to direct the oxygen-containing gas to the first duct and the third duct.

7. A burner apparatus according to claim 1 further comprising a fuel source operatively connected to the plurality of fuel lances.

8. A burner apparatus according to claim 1, wherein the plurality of fuel lances pass through the burner tile.

9. A burner apparatus according to claim 1, wherein the discharge end of the primary flow passage of the burner tile has a circular cross-section.

10. A burner apparatus according to claim 1 further comprising a second Coanda feature extending from the burner tile, the second Coanda feature having a Coanda surface extending into the primary flow passage of the burner tile at the discharge end of the primary flow passage adjacent a second fuel lance of the plurality of fuel lances to deflect a portion of the stabilized flame toward the discharge nozzle of the second of the plurality of fuel lances.

11. A burner apparatus according to claim 1, wherein the or each Coanda surface extends into the primary flow passage around only a portion of the perimeter of the discharge end of the primary flow passage.

12. A burner apparatus according to claim 1, wherein said apparatus is devoid of separate or secondary passages for redirecting the stabilized flame.

13. A method of combustion comprising:

supplying a first gaseous fuel to a plurality of fuel lances of a burner apparatus, the burner apparatus comprising:

a fluid-based flame stabilizer for discharging a stabilized flame therefrom;

a burner tile defining a primary flow passage therein, the primary flow passage having an inlet end, a discharge end, and a wall connecting the inlet end to the discharge end and surrounding the primary flow passage, wherein the fluid-based flame stabilizer is operatively disposed to direct the stabilized flame into the primary flow passage of the burner tile; and the plurality of fuel lances associated with the burner tile, each of the plurality of fuel lances having a discharge nozzle, the discharge nozzles of the plurality of fuel lances being positioned proximate the discharge end of the primary flow passage of the burner tile and spaced to distribute the first gaseous fuel proximate the discharge end of the primary flow passage of the burner tile;

wherein a first Coanda feature having a Coanda surface directs a portion of the stabilized flame from the primary flow passage defined by the burner tile at the discharge end of the primary flow passage toward at least one first fuel lance of the plurality of fuel lances to cross light the at least one first fuel lance; and igniting and sustaining combustion of the first gaseous fuel by cross lighting at the discharge nozzles by flow from the fluid-based flame stabilizer along the Coanda surface toward the discharge nozzles;

wherein the first Coanda feature having a Coanda surface protrudes into the primary flow passage.

14. A method according to claim 13, wherein the discharge nozzles are located within 10 cm (3.94 inches) of the discharge end of the primary flow passage of the burner tile.

15. A method according to claim 13, wherein the fluid-based flame stabilizer comprises:

a first duct having an inlet end, a discharge end, and a wall extending from the inlet end of the first duct to the discharge end of the first duct, the wall thereby defining a first passage for passing a first oxygen-containing gas therethrough;

a second duct having an inlet end, a discharge end, and a wall extending from the inlet end of the second duct to the discharge end of the second duct, the first duct disposed partially within the second duct thereby defining a second passage between the external surface of the first duct and the internal surface of the second duct for passing a second gaseous fuel therethrough, wherein the discharge end of the first duct is recessed from the discharge end of the second duct; and a third duct having an inlet end, a discharge end, and a wall extending from the inlet end of the third duct to the discharge end of the third duct, the second duct disposed partially within the third duct thereby defining a third passage between the external surface of the second duct and the internal surface of the third duct for passing a second oxygen-containing gas therethrough, wherein the discharge end of the second duct is recessed from the discharge end of the third duct.

* * * * *